US007751744B2

(12) United States Patent
Ohmichi et al.

(10) Patent No.: US 7,751,744 B2
(45) Date of Patent: Jul. 6, 2010

(54) DEVELOPMENT APPARATUS, PROCESS CARTRIDGE AND IMAGE FORMATION APPARATUS, INCLUDING DUST PREVENTION SHEET

(75) Inventors: Yoshiki Ohmichi, Toyokawa (JP); Masayoshi Kuroda, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 23 days.

(21) Appl. No.: 11/480,374

(22) Filed: Jul. 5, 2006

(65) Prior Publication Data

US 2007/0025757 A1 Feb. 1, 2007

(30) Foreign Application Priority Data

Jul. 26, 2005 (JP) ..... 2005-215804

(51) Int. Cl.
*G03G 15/08* (2006.01)

(52) U.S. Cl. ..... 399/103

(58) Field of Classification Search ..... 399/103, 399/274, 284, 105, 283, 279
See application file for complete search history.

(56) References Cited

U.S. PATENT DOCUMENTS 4,615,608 A * 10/1986 Mizutani ..... 399/103
4,748,472 A * 5/1988 Mukai et al. ..... 399/283
5,081,504 A * 1/1992 Morisawa et al. ..... 399/350
7,058,349 B2 * 6/2006 Kamimura ..... 399/361
2007/0177906 A1 * 8/2007 Yamanaka et al. ..... 399/279

FOREIGN PATENT DOCUMENTS

JP 55-103652 U 7/1980
JP 2000-284590 A 10/2000
JP 2001-134079 A 5/2001
JP 2002-023489 A 1/2002
JP 2002023489 A * 1/2002
JP 2003-162147 A 6/2003
JP 2003-330276 A 11/2003

OTHER PUBLICATIONS

Official Action issued by the CN Patent Office in corresponding CN Patent Application No. 200610107468.6; and English-language translation thereof.
Official Action issued by the JP Patent Office in corresponding JP Patent Application No. 2005-215804, Oct. 23, 2007; and English-language translation thereof.

* cited by examiner

*Primary Examiner*—Quana M Grainger
(74) *Attorney, Agent, or Firm*—Buchanan Ingersoll & Rooney PC

(57) ABSTRACT

A development apparatus has a casing, a regulation plate, a smoky dust prevention sheet and a backup member which are fixed together onto the casing with a screw. The backup member sandwiches a fixed end portion of the smoky dust prevention sheet with the regulation plate. Therefore, the backup member suppresses detachment of the smoky dust prevention sheet from the regulation plate. Thus, the smoky dust prevention sheet is prevented from being detached from the regulation plate when the smoky dust prevention sheet is used in contact with a development roller in the state of being bended.

19 Claims, 13 Drawing Sheets

DEVELOPMENT APPARATUS, PROCESS CARTRIDGE AND IMAGE FORMATION APPARATUS, INCLUDING DUST PREVENTION SHEET

CROSS-REFERENCE TO RELATED APPLICATIONS

This application is based on application No. 2005-215804 filed in Japan, the entire content of which is hereby incorporated by reference.

BACKGROUND OF THE INVENTION

The present invention relates to a development apparatus applied to copying machines, printers, facsimiles and complex machines having these multiple functions, in which images are reproduced with use of, for example, powder developers, and further relates to a process cartridge having the development apparatus and an image formation apparatus having the development apparatus.

Conventionally, in the field of electrophotographic image formation apparatuses for reproducing images with use of powder developers, various technologies have been proposed for the purpose of preventing the powder developers from flying away from development apparatuses which feed powder developers to electrostatic latent images formed on electrostatic latent image holder and develop the images.

For example, there has been disclosed a technology where a smoky dust prevention sheet is stuck on a regulation plate for regulating an amount of a developer transported by a development roller, and one end of the smoky dust prevention sheet is brought into contact with the development roller in order to seal a gap between the development roller and the regulation plate with the smoky dust prevention sheet (see JP 2000-284590 A).

However, in the conventional development apparatus, the smoky dust prevention sheet is simply stuck on the regulation plate, and a sticking area of the smoky dust prevention sheet is extremely small. Therefore, the smoky dust prevention sheet could be detached from the regulation plate when the smoky dust prevention sheet is used in contact with the development roller in the state of being bended.

Moreover, in order to adjust the gap between the regulation plate and the development roller with the regulation plate, generally, the regulation plate is provided with a long hole and fixed onto a casing with a screw. Consequently, the smoky dust prevention sheet needs a hole in a position corresponding to the screw. This proportionally decreases the rigidity of the smoky dust prevention sheet, and thereby the smoky dust prevention sheet is more easily detached.

SUMMARY OF THE INVENTION

An object of the present invention is to provide a development apparatus capable of preventing a smoky dust prevention sheet from being detached from a regulation plate to enhance durability.

In order to accomplish the object, a first aspect of the present invention provides a development apparatus, comprising:

a casing having an opening;

a developer holder positioned in the opening of the casing and holding a powder developer in the casing on a surface of the developer holder to transport the powder developer;

a regulation plate mounted on the casing in such a way that an end portion of the regulation plate comes close to the surface of the developer holder so as to regulate a layer thickness of the developer on the surface of the developer holder, the regulation plate extending in a direction orthogonal to a transportation direction of the developer on the surface of the developer holder;

a smoky dust prevention sheet extending in the direction orthogonal to the transportation direction of the developer on the surface of the developer holder, wherein one end of the smoky dust prevention sheet, as a fixed end portion, is fixed onto a face of the regulation plate corresponding to a downstream side with respect to the transportation direction of the developer, and wherein the other end of the smoky dust prevention sheet, as a feed end portion, is in contact with the surface of the developer holder; and a backup member for sandwiching the fixed end portion of the smoky dust prevention sheet with the regulation plate and extending in the direction orthogonal to the transportation direction of the developer on the surface of the developer holder.

In the first aspect of the invention, the development apparatus has the backup member for sandwiching the fixed end portion of the smoky dust prevention sheet with the regulation plate. Therefore, the backup member suppresses detachment of the smoky dust prevention sheet from the regulation plate, and therefore the smoky dust prevention sheet is prevented from being detached from the regulation plate when the smoky dust prevention sheet is used in contact with the developer holder in the state of being bended.

Moreover, the backup member suppresses lifting of the smoky dust prevention sheet from the regulation plate and prevents the smoky dust prevention sheet in the free end portion of the smoky dust prevention sheet from being waved (i.e. having wrinkles). Consequently, it becomes possible to uniform a pressing force of the smoky dust prevention sheet on the surface of the developer holder over the longitudinal direction of the sheet, thereby achieving an almost uniform layer thickness of the developer on the surface of the developer holder. Therefore, irregularity in density of images is prevented.

Moreover, since the backup member is pressing the smoky dust prevention sheet, it is possible to decrease a gap between the regulation plate and the smoky dust prevention sheet on the side of the developer holder. Thereby, the powder developer is prevented from accumulating in the gap. More particularly, it is prevented that the power developer accumulates in the gap, as the result, forms lumps and falls down on the surface of the developer holder and stains images.

A second aspect of the present invention provides a development apparatus, comprising:

casing having an opening;

a developer holder positioned in the opening of the casing and holding a powder developer in the casing on a surface of the developer holder to transport the powder developer;

a regulation plate mounted on the casing in such a way that an end portion of the regulation plate comes close to the surface of the developer holder so as to regulate a layer thickness of the developer on the surface of the developer holder, the regulation plate extending in a direction orthogonal to a transportation direction of the developer on the surface of the developer holder;

a screw for fixing the regulation plate onto the casing;

a spacer member mounted on a face of the regulation plate corresponding to a downstream side with respect to the transportation direction of the developer, the spacer member having a thickness larger than a portion of the screw protruding from the face of the regulation plate corresponding to the downstream side with respect to the transportation direction of the developer, and the spacer member extending in the direction orthogonal to the transportation direction of the developer on the surface of the developer holder; and a smoky dust prevention sheet extending in the direction orthogonal to the transportation direction of the developer on the surface of the developer holder, wherein one end of the smoky dust prevention sheet, as a fixed end portion, is glued to the face of the regulation plate corresponding to the downstream side with respect to the transportation direction of the developer, and wherein the other end of the smoky dust prevention sheet, as a feed end portion, is in contact with the surface of the developer holder.

In the second aspect of the invention, the development apparatus has a spacer member mounted on a downstream face of the regulation plate and having a thickness larger than a portion of the screw protruding from the downstream face of the regulation plate. Therefore, the screw does not protrude from the downstream face of the spacer member. Therefore, it is not necessary to provide a hole for avoiding the screw in the smoky dust prevention sheet, which makes it possible to glue the smoky dust prevention sheet to the downstream face of the spacer member while keeping rigidity of the smoky dust prevention sheet. Moreover, it becomes possible to increase a glued area of the smoky dust prevention sheet. Therefore, detachment of the smoky dust prevention sheet from the spacer member is prevented when the smoky dust prevention sheet is used in contact with the developer holder in the state of being bended.

It is also possible for the downstream face of the spacer member to have an almost uniform height over the longitudinal direction. Therefore, the pressing force of the smoky dust prevention sheet on the surface of the developer holder can be almost uniform over the longitudinal direction of the sheet. Thereby, irregularity in density of images is reliably prevented.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinbelow, a development apparatus in the present invention will be described in detail in conjunction with embodiments with reference to the drawings.

First Embodiment

Figure 1:
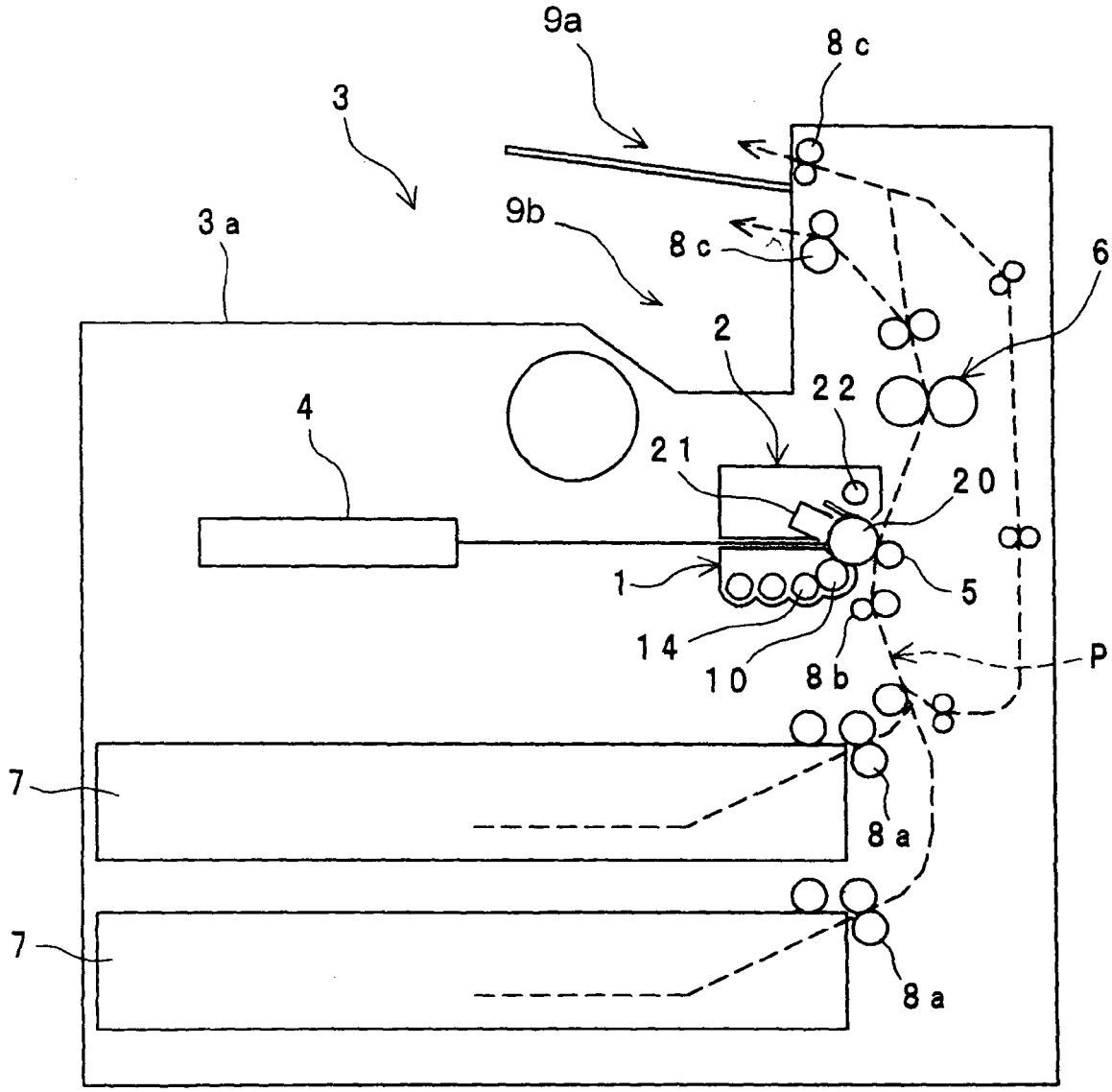
FIG. 1 is a simplified structure view showing an image formation apparatus having a development apparatus in a first embodiment of the present invention.

FIG. 1 shows a cross-sectional structure of a monochrome-type image formation apparatus having a development apparatus in one embodiment of the present invention. The image formation apparatus 3 has an imaging cartridge 2 as a process cartridge in a main casing 3*a*.

The imaging cartridge 2 integrally has a drum-shaped photoreceptor 20, an electrifier 21, a development apparatus 1 and a collector device 22. The electrifier 21 charges an outer surface of the photoreceptor 20. The development apparatus 1 exposes the outer surface of the charged photoreceptor 20 with a (later-described) exposure device 4 to develop electrostatic latent images formed on the outer surface of the photoreceptor 20 (to make the images visible) with a developer. The collector device 22 collects the developer remaining on the outer surface of the photoreceptor 20 after the developed developer is transferred to (unshown) paper. The imaging cartridge 2 is freely mounted on and dismounted from the main casing 3*a*.

The exposure device 4 is placed on the left-hand side of the imaging cartridge 2 in FIG. 1, so that the outer surface of the photoreceptor 20 is exposed to light corresponding to reproduction target images from between the electrifier 21 and the development apparatus 1.

A transfer roller 5 is placed on the right-hand side of the photoreceptor 20 with a paper feed line P (shown by a broken line) interposed therebetween. A fixing unit 6 for fixing toner on paper is placed on the upper side of the imaging cartridge 2. A paper feed cassette 7 which houses (unshown) paper is placed on the lower side of the imaging cartridge 2.

Description will be given of the operation of the thus-structured image formation apparatus 3.

During image formation, paper is fed from the paper feed cassette 7 to the paper feed line P by a paper feed roller 8*a*, and is sent to a toner transfer position between the photoreceptor 20 and the transfer roller 5 by a transportation roller 8*b*.

In the imaging cartridge 2, the surface of the photoreceptor 20 is evenly charged by the electrifier 21 and is further exposed to light by the exposure device 4. Thereby a latent image is formed on the surface of the photoreceptor 20.

Then, the latent image is developed with a developer (shown by symbol D in FIG. 2) fed from the development apparatus 1, by which a developer image corresponding to a reproduction target image is formed. More specifically, in the development apparatus 1, development is performed with use of the two-component developer D containing a toner and a carrier, so that a toner image is formed on the surface of the photoreceptor 20.

The toner image formed on the photoreceptor 20 is transferred onto the paper sent to the toner transfer position by the transfer roller 5. The paper with the toner image transferred thereon is transported through the fixing unit 6, by which the toner image is fixed onto the paper. Then, the paper having the toner image fixed thereon is discharged to upper and lower discharge portions 9*a*, 9*b* by a discharge roller 8*c*.

Figure 2:
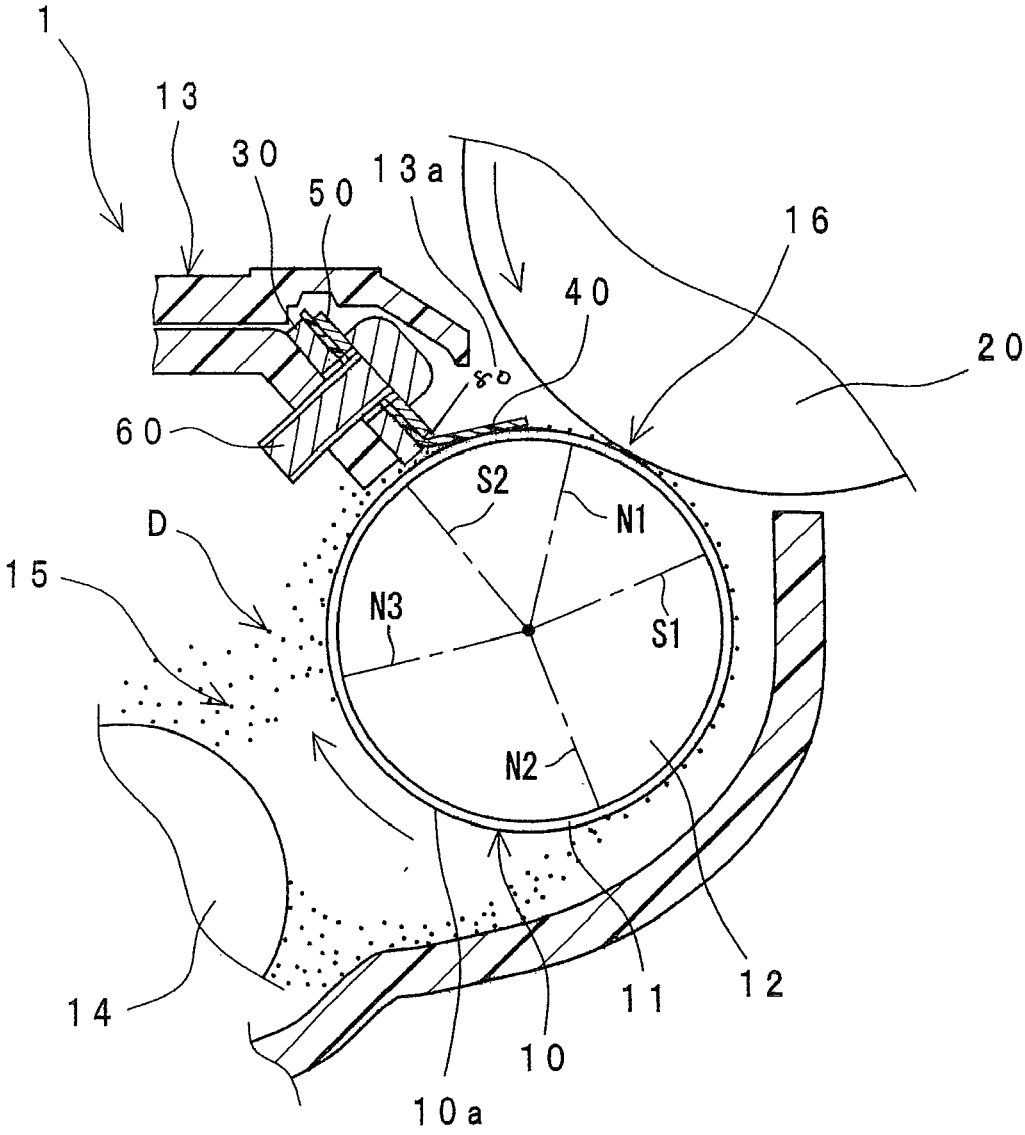
FIG. 2 is a fragmentary cross-sectional view showing the development apparatus in the first embodiment of the present invention.

FIG. 2 shows a fragmental cross-sectional view of the development apparatus 1 mounted on the imaging cartridge 2.

The development apparatus 1 has a casing 13 which has an opening 13*a* formed so as to face the photoreceptor 20. In the vicinity of the opening 13*a*, a development roller 10 serving as the developer holder is placed facing the photoreceptor 20. A feed screw 14 is placed inside the casing 13 and below the development roller 10.

The developer D is housed in the casing 13. The developer D contains two components composed of a nonmagnetic toner consumed by the image formation and a magnetic carrier for charging the toner to a specified polarity. During the image formation, the toner is fed to the photoreceptor 20 so that electrostatic latent images are changed into visualized ones. Thereafter, the toner is transferred onto the paper through the photoreceptor 20.

The development roller 10 has a cylinder-shaped sleeve 11 and a magnet 12 placed inside the sleeve 11. The sleeve 11 is interlocked with an unshown motor and rotates clockwise in the drawing.

The magnet 12 is locked so as not to rotate in the sleeve 11. In the magnet 12, a plurality of magnetic poles are placed facing the inner surface of the sleeve 11. Specifically, for example, a magnetic pole N1 (transportation pole) and a magnetic pole S1 (development pole) are placed respectively on the upstream side and the downstream side of a development region 16 where the development roller 10 and the photoreceptor 20 are confronted each other. Moreover, the magnetic pole N2 (seal pole) and a magnetic pole N3 (catch pole) are placed respectively on the upstream side and the downstream side of a feed region 15 where the development roller 10 and the feed screw 14 are confronted each other. A magnetic pole S2 (regulation pole) is placed between the magnetic pole N3 and the magnetic pole N1.

During the image formation, the sleeve 11 of the development roller 10 rotates clockwise and receives the developer D from the feed screw 14 by using the catch pole N3. The layer thickness of the developer D on a surface 10*a* of the development roller 10 is stably regulated by the regulation pole S2 and a (later-described) regulation plate 30 mounted on the casing 13.

The transportation pole N1 helps to transport the developer D to the development pole S1 facing the photoreceptor 20. The development pole S1 has magnetic flux density higher than that of other poles and contributes to development. The seal pole N2 prevents the developer D from leaking from the casing 13. Thereby, the developer D is transported while the toner is sealed so as not to fly from the casing 13.

An interval between the seal pole N2 and the catch pole N3 has a function to detach the toner-consumed developer D from the surface 10*a* of the development roller 10. Moreover, it also has a function to replace the toner-consumed developer D with a new developers D.

Figure 3:
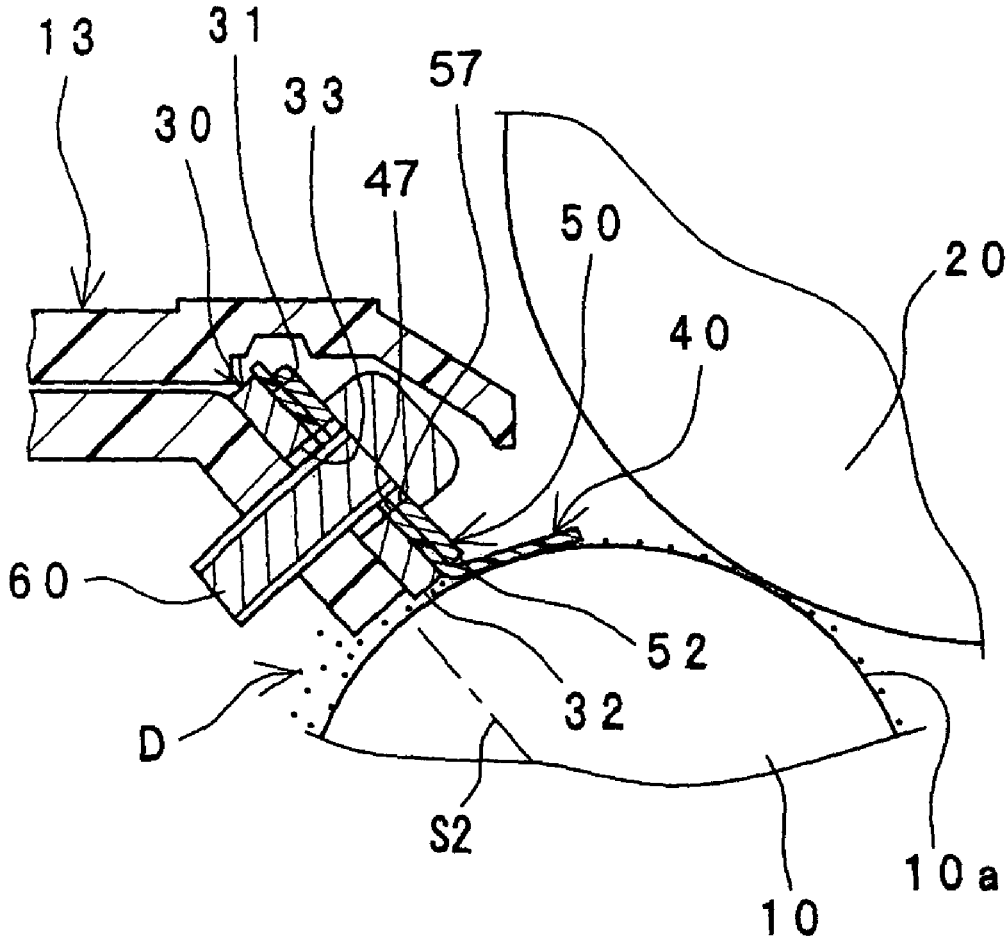
FIG. 3 is an enlarged cross-sectional view showing the development apparatus in the first embodiment of the present invention in the state that a smoky dust prevention sheet is sandwiched between a regulation plate and a backup member and fixed by a screw.
Figure 4:
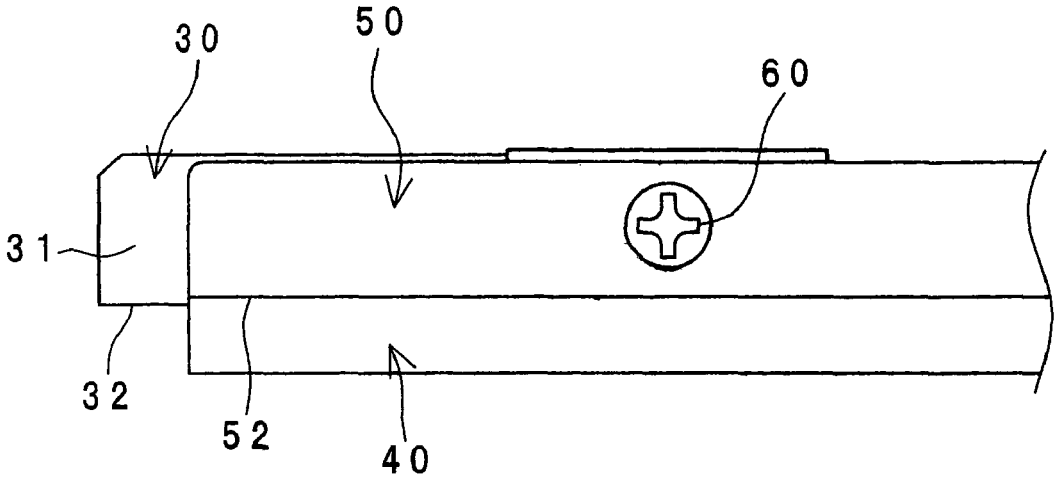
FIG. 4 is a front view showing the development apparatus in the first embodiment of the present invention.

As shown in an enlarged cross-sectional view of FIG. 3, the regulation plate 30 is mounted on the upper side of the development roller 10 in the casing 13. An end portion of the regulation plate 30 is in the vicinity of the surface 10*a* of the development roller 10 and faces the magnetic pole S2. A confronting face 32 of the regulation plate 30, which faces the development roller 10, regulates the layer thickness of the developer D on the surface 10*a* of the development roller 10. The regulation plate 30 is made of, for example, magnetic materials such as iron.

A smoky dust prevention sheet 40 is mounted on the regulation plate 30. A fixed end portion on one end of the smoky dust prevention sheet 40 is fixed onto a face (downstream face 31) of the regulation plate 30, which face is located on the downstream side with respect to the direction in which the development roller 10 transports the developer D. Moreover, a free end portion on the other end of the smoky dust prevention sheet 40 is in contact with the surface 10*a* of the development roller 10. The smoky dust prevention sheet 40 is preferably made of elastic material such as a synthetic resin of urethane or PET (polyethylene terephthalate), which can reduce a pressing force on the development roller 10. Moreover, the thickness of the smoky dust prevention sheet 40 should preferably be, for example, 0.05 to 0.3 mm.

A backup member 50 is provided for sandwiching the fixed end portion of the smoky dust prevention sheet 40 with the regulation plate 30. The backup member 50 should preferably be made of materials having high rigidity such as sheet metals, which can bring the smoky dust prevention sheet 40 into close contact with the regulation plate 30.

A confronting face 52 of the backup member 50 facing the development roller 10 is in a position farther away from the side of the development roller 10 than the confronting face 32 of the regulation plate 30.

On the surface 10*a* of the development roller 10, as shown in FIGS. 2 and 3, the regulation plate 30, and the backup member 50 respectively extend in the direction orthogonal to the transportation direction of the developer D (in longitudinal direction). The fixed end portion of the smoky dust prevention sheet 40 extends in the direction orthogonal to the transportation direction of the developer D. The free end portion extends in the transportation direction of the developer D. A transition portion 80 is formed between the fixed end and the free end at the portion where the smoky dusk prevention member includes an angle formed in the transition from the fixed end portion extending in the direction orthogonal to the transportation direction of the developer D and the free end portion extending in the transportation direction of the developer D. The longitudinal size of the smoky dust prevention sheet 40 is almost identical to the longitudinal size of the backup member 50.

The regulation plate 30, the smoky dust prevention sheet 40 and the backup member 50 are fixed together onto the casing 13 with a screw 60.

A plurality of the screws 60 are preferably placed along the longitudinal direction of the regulation plate 30. Thereby, a distance between the development roller 10 and the confronting face 32 of the regulation plate 30 is made almost uniform over the longitudinal direction.

The backup member 50 has a through hole 57, through which the screw 60 is inserted and which is smaller than an outer diameter of head of the screw 60. The smoky dust prevention sheet 40 has a through hole 47 through which the screw 60 is inserted.

The regulation plate 30 has a longer hole 33 through which the screw 60 is inserted. It is possible to adjust a gap between the regulation plate 30 and the development roller 10 by sliding the regulation plate 30 against the screw 60 through the longer hole 33.

It is to be noted that double-faced tapes or the like may be used for sticking the regulation plate 30 to the smoky dust prevention sheet 40, and the smoky dust prevention sheet 40 to the backup member 50. This allows the smoky dust prevention sheet 40 and the backup member 50 to be fixed more solidly.

In the thus-structured development apparatus as shown in FIG. 2 and FIG. 3, the toner and the carrier which constitute the developer D are mixed and agitated by the mixture and agitation action of the feed screw 14 and the like. The toner and the carrier are charged to specified polarities by friction contact with each other (for example, the toner is charged to negative polarity while the carrier is charged to positive polarity).

The charged developer D is fed from the feed screw 14 to the surface 10*a* of the development roller 10 in the feed region 15. The developer D fed to the sleeve 11 is held on the outer surface of the sleeve 11 by magnetism of the magnet 12, and is transported clockwise along with the rotation of the sleeve 11.

The developer D transported by the sleeve 11 is regulated to be a specific amount by the regulation plate 30, and then comes into contact with the outer surface of the photoreceptor 20 in the development region 16 for development of an electrostatic latent image. Thereafter, the developer D passes through the development region 16 and leaves the outer surface of the sleeve 11 immediately before the feed region 15, and is mixed with a developer D agitated by the feed screw 14.

The magnetic carrier in the developer D held on the outer surface of the sleeve 11 is stably held on the outer surface of the sleeve 11 by the magnetism of the magnet 12. On the other hand, the non-magnetic toner is held on the magnetic carrier by electrostatic force which is generated by the friction contact between the magnetic carrier and the non-magnetic toner.

However, not all part of the toner is sufficiently charged. Insufficiently charged toner parts float inside the casing 13. Some of them go into the downstream side of the regulation plate 30 along with the rotation of the sleeve 11.

However, the downstream side of the regulation plate 30 is sealed with the smoky dust prevention sheet 40, and therefore, powder and smoke-like toner does not fly out of the casing 13.

Further, the regulation plate 30 and the backup member 50 sandwich the fixed end portion of the smoky dust prevention sheet 40, and therefore, the backup member 50 suppresses detachment of the smoky dust prevention sheet 40 from the regulation plate 30. More particularly, the backup member 50 increases the rigidity of the smoky dust prevention sheet 40, which makes it difficult to detach the smoky dust prevention sheet 40 from the regulation plate 30. Therefore, the smoky dust prevention sheet 40 is not detached from the regulation plate 30 even when the smoky dust prevention sheet 40 is used in contact with the development roller 10 in the bended state.

Moreover, the backup member 50 suppresses lifting of the smoky dust prevention sheet 40 from the regulation plate 30 so that the backup member 50 prevents the smoky dust prevention sheet 40 from being waved or wrinkled in the free end portion thereof. Consequently, it becomes possible to uniform a pressing force of the smoky dust prevention sheet 40 against the surface 10*a* of the development roller 10 over the longitudinal direction of the sheet 40. Thereby, it is possible to achieve an almost uniform layer thickness of the developer D on the surface 10*a* of the development roller 10, and therefore, to prevent irregular density of images. On the other hand, if the smoky dust prevention sheet 40 is wrinkled, the contact pressure of the smoky dust prevention sheet 40 against the development roller 10 is partially intensified, and therefore, the layer thickness of the developer D is partially reduced. Thus, irregularity in density is generated at the time of producing high density images such as black solid images.

Moreover, since the backup member 50 presses the smoky dust prevention sheet 40, it is possible to decrease a gap between the regulation plate 30 and the smoky dust prevention sheet 40 on the side of the development roller 10. This prevents the powder developer D (mainly toner) from accumulating in the gap. More particularly, it is prevented that the toner accumulates in the gap, forms lumps, falls down on the surface 10*a* of the developer holder 10 and stains images.

In short, since the development apparatus has the regulation plate 30 placed on the upper side of the development roller 10, the images are stained when the toner accumulated on the regulation plate 30 falls down on the development roller 10. However, the action of the backup member 50 prevents the toner from accumulating on the regulation plate 30. The development apparatus shown in the prior art has the regulation plate placed on the lower side of the development roller, and therefore the toner accumulated on the regulation plate does not fall down on the development roller at all, thereby causing no such problem as stained images.

Moreover, the confronting face 52 of the backup member 50 is in a position farther away from the side of the development roller 10 than the confronting face 32 of the regulation plate 30. Therefore, the confronting face 52 of the backup member 50 does not protrude much more toward the development roller 10 than the confronting face 32 of the regulation plate 30. Thus, the confronting face 52 of the backup member 50 does not change the layer thickness of the developer D regulated by the regulation plate 30, which makes it possible to eliminate influence on images.

It is to be noted that the confronting face 52 of the backup member 50 should preferably be flush with the confronting face 32 of the regulation plate 30, which makes it possible to nearly eliminate a gap (pocket) between the regulation plate 30 and the smoky dust prevention sheet 40 on the side of the development roller 10. This reliably prevents the toner from accumulating in the gap.

A process cartridge and an image formation apparatus according to the present invention have the above-stated development apparatuses which prevents the smoky dust prevention sheet 40 from being detached from the regulation plate 30 during use, which enhances durability of the process cartridge and the image formation apparatus.

Second Embodiment

Figure 5:
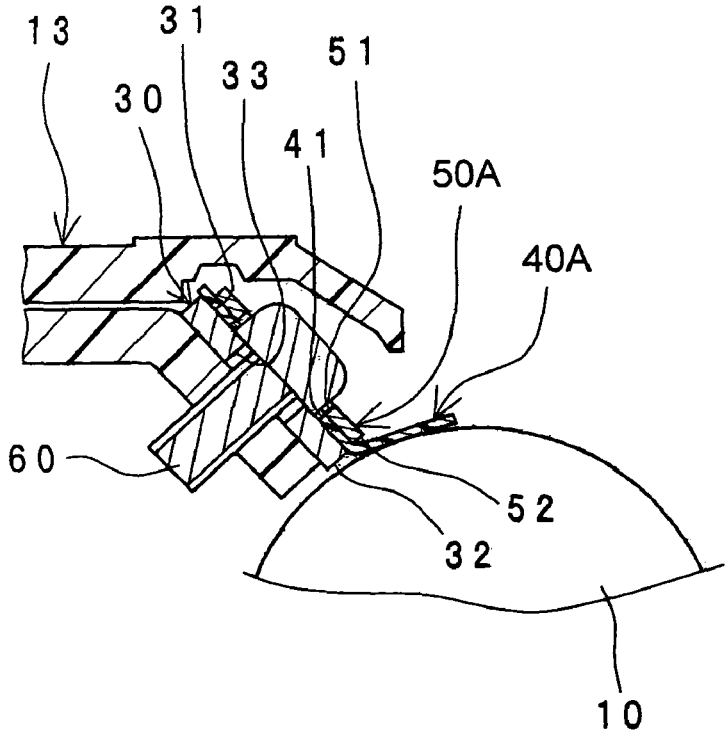
FIG. 5 is a cross-sectional view showing a development apparatus in a second embodiment of the present invention in the state that a smoky dust prevention sheet and a backup member are stuck on a regulation plate.

FIG. 5 shows a development apparatus in a second embodiment of the present invention. The second embodiment is different from the first embodiment (FIG. 3) in the points that the regulation plate 30 is fixed onto the casing 13 with the screw 60, that a smoky dust prevention sheet 40A is glued to the regulation plate 30 with a double-faced tape or the like, and that a backup member 50A is glued to the smoky dust prevention sheet 40A with a double-faced tape or the like.

Further, the smoky dust prevention sheet 40A has a leak-off hole 41 through which the screw 60 is inserted and which is larger than the external diameter of the head of the screw 60 so that clamping force of the screw 60 is not transmitted to the smoky dust prevention sheet 40A. The backup member 50A has a leak-off hole 51 through which the screw 60 is inserted and which is larger than the external diameter of the head of the screw 60 so that clamping force of the screw 60 is not transmitted to the backup member 50A. The long hole 33 of the regulation plate 30 receives insertion of the screw 60 and is smaller than the external diameter of the head of the screw 60.

Third Embodiment

Figure 6:
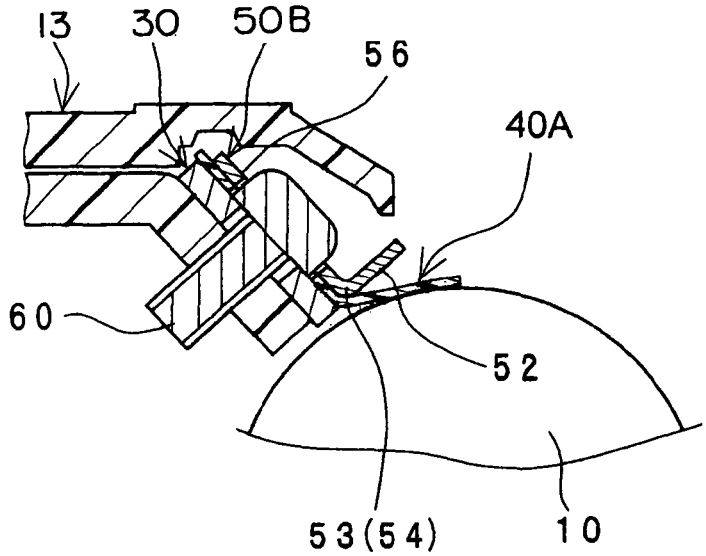
FIG. 6 is a cross-sectional view showing a development apparatus in a third embodiment of the present invention in the state that an end of a backup member is folded in L shape.

FIG. 6 shows a development apparatus in a third embodiment of the present invention. The third embodiment is different from the second embodiment (FIG. 5) in the point that a backup member 50B has a plate-like main portion 56 and a reinforcement portion 53 connected to the plate-like main portion 56 on the side of the development roller 10 and having flexural rigidity larger than the plate-like main portion 56.

The reinforcement portion 53 extends in a direction orthogonal to the transportation direction of the developer D (in longitudinal direction) on the surface of the development roller 10. The reinforcement portion 53 is a folded portion 54 folded in L shape to the opposite side of the regulation plate 30. A confronting face 52 of the folded portion 54 is almost flush with the confronting face 32 of the regulation plate 30.

Figure 7:
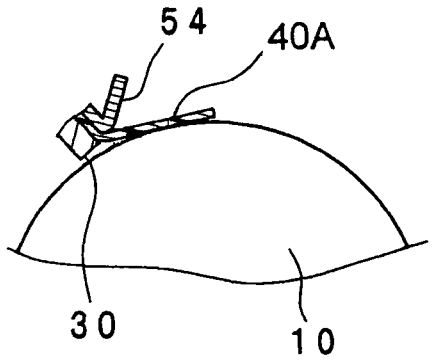
FIG. 7 is a cross-sectional view showing the development apparatus in the third embodiment of the present invention in the state that the end of the backup member is folded in V shape.
Figure 8:
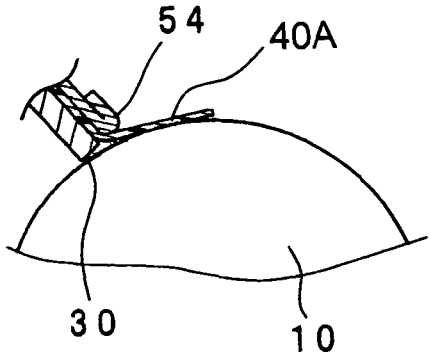
FIG. 8 is a cross-sectional view showing the development apparatus in the third embodiment of the present invention in the state that the end of the backup member is folded in U shape.

The shape of the folded portion 54 is not limited to the L shape, and may take a V shape as shown in FIG. 7 as well as a U shape which is completely folded back as shown in FIG. 8.

In the thus-structured development apparatus, the backup member 50*b* has the folded portion 54 as the reinforcement portion 53. Therefore, it is possible to increase the flexural rigidity of the backup member 50*b* in longitudinal direction on the side of the development roller 10, which allows the smoky dust prevention sheet 40 to be pressed to the regulation plate 30 almost uniformly over the longitudinal direction. Thus, the smoky dust prevention sheet 40 is almost uniformly bended over the longitudinal direction, so that the pressure applied to the developer D is stabilized on the surface 10*a* of the development roller 10, thereby allowing reliable prevention of irregular density of images.

It is to be noted that the reinforcement portion 53 may be made of materials having, for example, sufficient flexural rigidity and thickness.

Fourth Embodiment

Figure 9A:
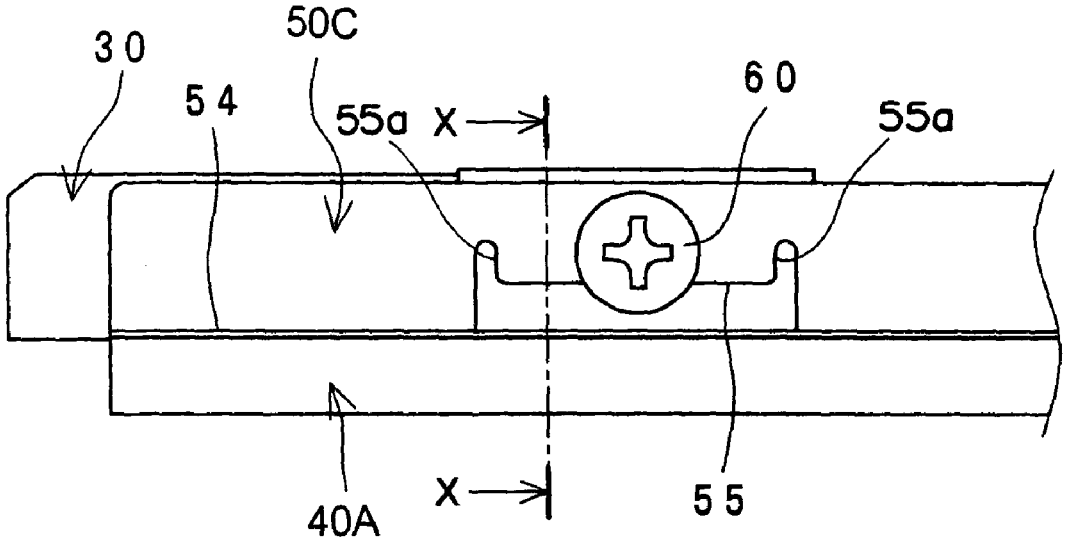
FIG. 9A is a front view showing a development apparatus in a fourth embodiment of the present invention in the state that a lower portion of a screw of a backup member is open.
Figure 9B:
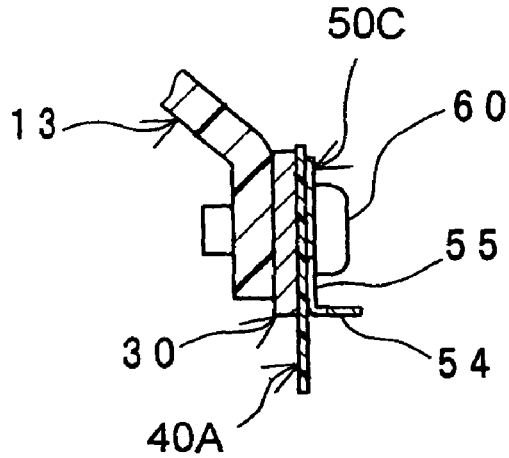
FIG. 9B is a cross-sectional view taken along line X-X of FIG. 9A.

FIG. 9A and FIG. 9B show a development apparatus in a fourth embodiment of the present invention. The fourth embodiment is different from the first embodiment (FIG. 3) in the point that a backup member 50C has an opening portion 55 extending from the position of the screw 60 (FIG. 3) to the side of the development roller 10.

The longitudinal length of the opening portion 55 in the backup member 50C is longer than the external diameter of the head of the screw 60. The length of the opening portion 55 in the longitudinal direction is almost three times larger than the external diameter of the head of the screw 60.

The opening portion 55 is linked to a through hole for the screw 60 whose hole is placed in the backup member 50C. The opening portion 55 has slits 55*a*, 55*a* which are placed on both ends of the opening portion 55 and extends in the transverse direction.

Thus, since the backup member 50C has the opening portion 55, it becomes possible to prevent clamping force of the screw 60 from being transmitted to a portion of the backup member 50C whose portion is located from the screw 60 to the side of the development roller 10. This makes it possible for the backup member 50C to almost uniformly press the smoky dust prevention sheet 40 over the longitudinal direction on the side of the development roller 10.

Thus, it becomes possible to almost uniform the pressing force of the smoky dust prevention sheet 40 over the longitudinal direction of the sheet 40 on the surface 10*a* of the development roller 10. Thereby, irregularity in density of images is reliably prevented.

The longitudinal length of the opening portion 55 is almost three times larger than the external diameter of the head of the screw 60, and the opening portion 55 has the slits 55*a*, and therefore, the clamping force of the screw 60 is more reliably prevented from being transmitted to the portion of the backup member 50C located from the screw 60 to the side of the development roller 10.

It is to be noted that the slits 55*a*, 55*a* may be removed from the opening portion 55. The longitudinal length of the opening portion 55 has only to be longer than the external diameter of the head of the screw 60.

The opening portion 55 need not necessarily link to the through hole of the screw 60 placed on the backup member 50C. Moreover, the shape of the opening portion 55 may have an I-shape along the longitudinal direction of the backup member 50C, or may have a C-shape along the periphery of the screw 60.

The backup member 50C shown in FIG. 9B has a folded portion 54 as described in the third embodiment (FIG. 6).

Figure 10A:
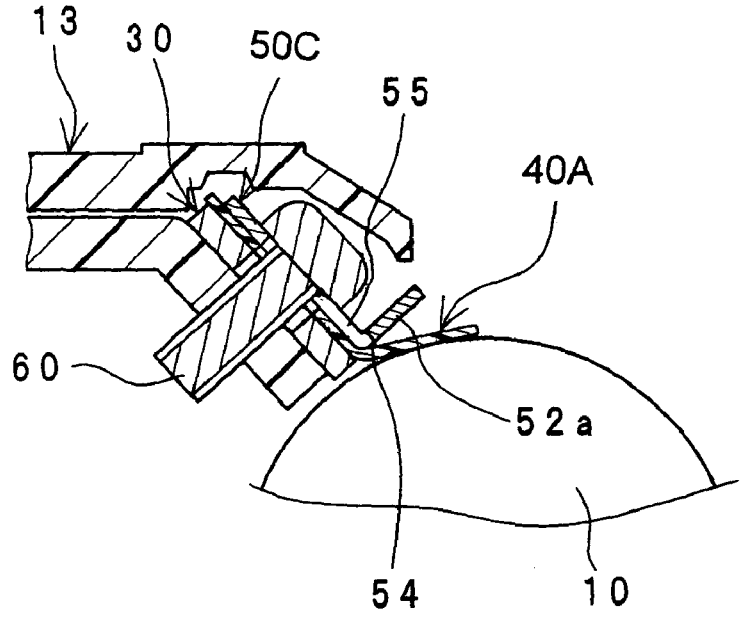
FIG. 10A is a cross-sectional view showing a section including the screw of FIG. 9A.
Figure 10B:
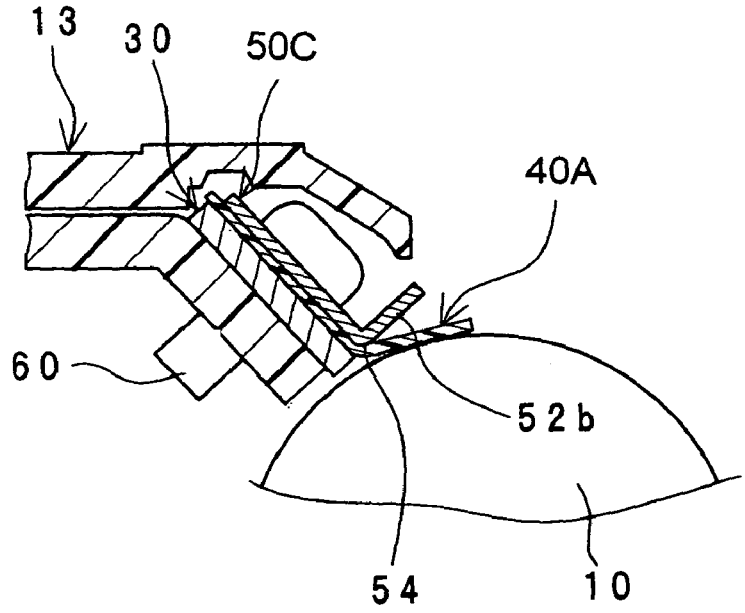
FIG. 10B is a cross-sectional view showing a section away from the screw of FIG. 9A.

As shown in FIGS. 10A and 10B, on the side of the folded portion 54, a traverse cross-sectional outline (FIG. 10A) of the backup member 50C including the opening portion 55

(the screw 60) is identical to that (FIG. 10B) of the backup member 50C excluding the opening portion 55 (the screw 60).

In other words, a confronting face 52*a* of the folded portion 54, which is located in the vicinity of the opening portion 55, does not protrude from a confronting face 52*b* of the folded portion 54, which is located away from the opening portion 55, toward the development roller 10. Thereby, the confronting face 52*a* of the folded portion 54 located in the vicinity of the opening portion 55 is prevented from excessively pressing the smoky dust prevention sheet 40, which prevents irregular density of images from being generated.

Figure 11:
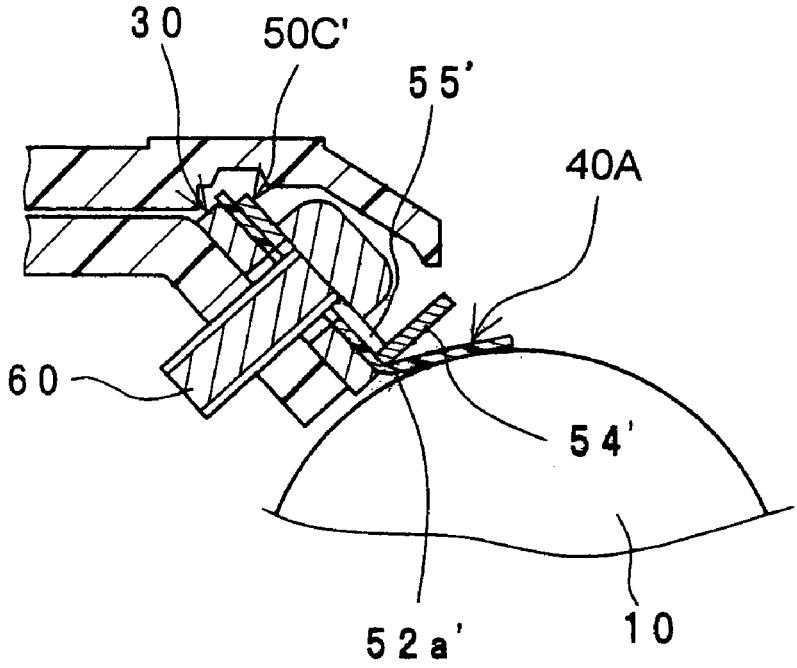
FIG. 11 is a cross-sectional view showing a comparative example to FIG. 10A.

On the other hand, in a comparative example shown in FIG. 11, a folded portion 54' in the vicinity of an opening portion 55' of the backup member 50C' is formed by bending, and the edge of the folded portion 54' protrudes toward the side of the development roller 10.

In other words, on the side of the folded portion 54', a transverse cross-sectional outline (FIG. 11) of the backup member 50C' including the opening portion 55' (the screw 60) is not identical to that (see FIG. 10B for reference) of the backup member 50C' excluding the opening portion 55' (the screw 60).

Thus, the confronting face 52*a*' of the folded portion 54' located in the vicinity of the opening portion 55' protrude from a confronting face (see the confronting face 52*b* in FIG. 10B) of the folded portion 54' located away from the opening portion 55' toward the side of the development roller 10. This causes the confronting face 52*a*' to strongly press the smoky dust prevention sheet 40 to the development roller 10, and therefore causes irregular density in the case of high density images such as black solid images.

Figure 12:
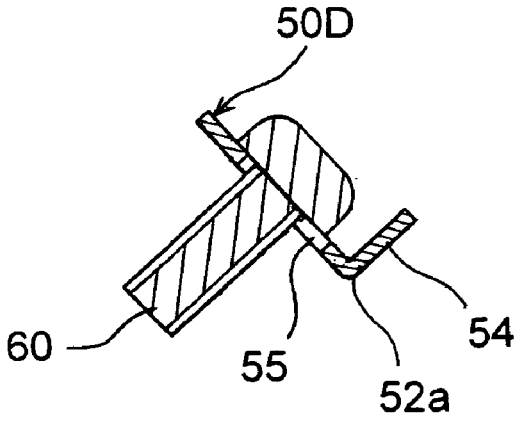
FIG. 12 is a cross-sectional view showing another backup member.

FIG. 12 shows another backup member 50D. The opening portion 55 may be positioned closer to the screw 60 than to a corner portion of the folded portion 54 under the condition that a traverse cross-sectional outline (FIG. 12) of the backup member 50D including the opening portion 55 (the screw 60) is identical to that (see FIG. 10B for reference) of the backup member 50D excluding the opening portion 55 (the screw 60) on the side of the folded portion 54.

Fifth Embodiment

Figure 13:
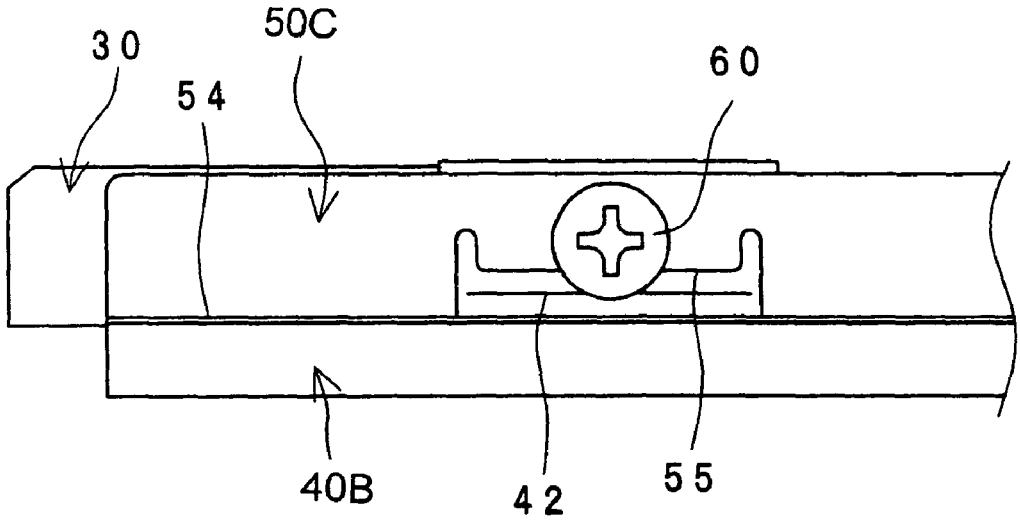
FIG. 13 is a front view showing a development apparatus in a fifth embodiment of the present invention in the state that a lower portion of a screw of a backup member is open and that a slit is formed on a smoky dust prevention sheet.

FIG. 13 shows a development apparatus in a fifth embodiment of the present invention. The fifth embodiment is different from the fourth embodiment (FIG. 9A) in the point that a smoky dust prevention sheet 40B has a slit 42 in a position overlapping with the opening portion 55 of the backup member 50C.

The slit 42 extends in longitudinal direction of the sheet 40B. The length of the slit 42 is almost identical to the longitudinal length of the opening portion 55 in the backup member 50C, and is sufficiently longer than the external diameter of the head of the screw 60.

Thus, since the smoky dust prevention sheet 40B has the slit 42, it becomes possible to prevent clamping force of the screw 60 from being transmitted from the screw 60 to the smoky dust prevention sheet 40B located on the side of the development roller 10. Thereby, pressing force of the smoky dust prevention sheet 40B on the surface 10*a* of the development roller 10 is almost uniformed over the longitudinal direction of the sheet 40B. This more reliably prevents irregularity in density of images.

Sixth Embodiment

Figure 14:
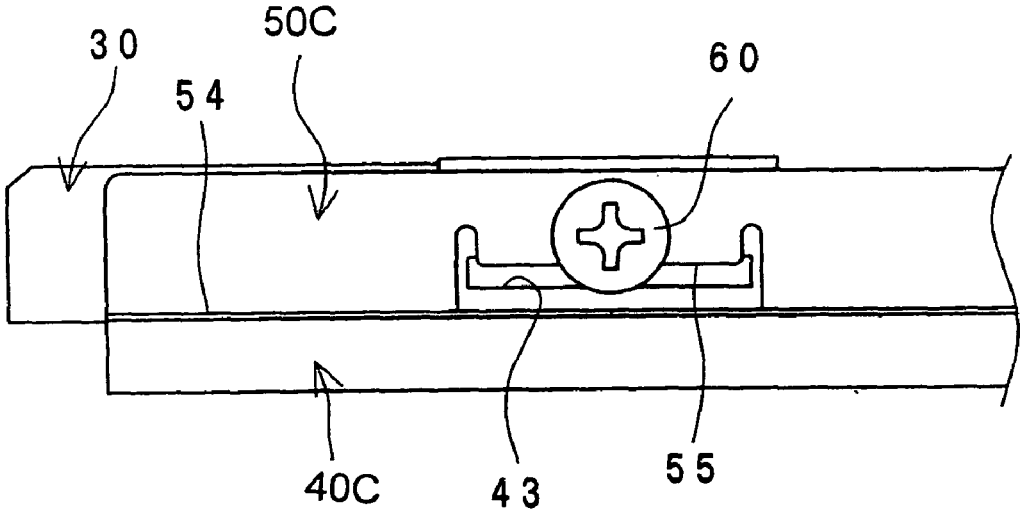
FIG. 14 is a front view showing a development apparatus in a sixth embodiment of the present invention in the state that a lower portion of a screw of a backup member is open and that a hole portion is formed on a smoky dust prevention sheet.

FIG. 14 shows a development apparatus in a sixth embodiment of the present invention. The sixth embodiment is different from the fourth embodiment (FIG. 9A) in the point that a smoky dust prevention sheet 40C has a hole portion 43 in a position overlapping with the opening portion 55 of the backup member 50C.

The hole portion 43 extends in longitudinal direction of the sheet 40C. The longitudinal length of the hole portion 43 is almost identical to the longitudinal length of the opening portion 55 in the backup member 50C, and is sufficiently longer than the external diameter of the head of the screw 60.

Thus, since the smoky dust prevention sheet 40C has the hole portion 43, it becomes possible to prevent clamping force of the screw 60 from being transmitted from the screw 60 to the smoky dust prevention sheet 40C on the side of the development roller 10. Thereby, pressing force of the smoky dust prevention sheet 40C on the surface 10*a* of the development roller 10 is almost uniformed over the longitudinal direction of the smoky dust prevention sheet 40C. This more reliably prevents irregularity in density of images.

Seventh Embodiment

Figure 15:
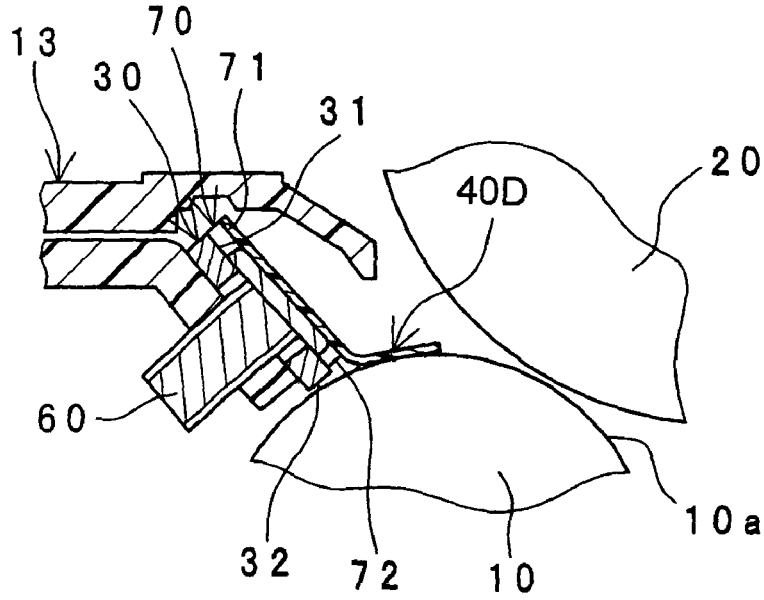
FIG. 15 is a cross-sectional view showing a development apparatus in a seventh embodiment of the present invention in the state that a spacer member identical in thickness to a screw head is stuck on a section of a regulation plate excluding the screw head, and that a smoky dust prevention sheet is stuck on the spacer member.
Figure 16:
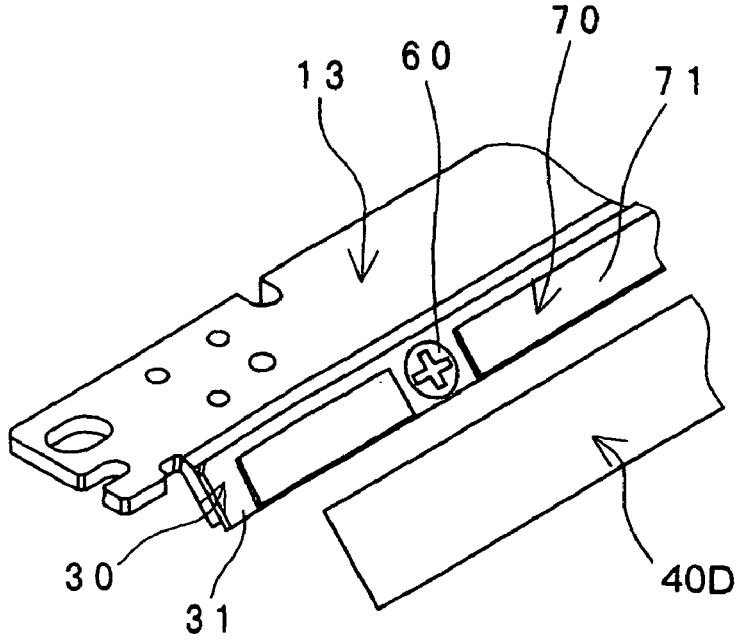
FIG. 16 is a perspective view showing FIG. 15 in an exploded state.

FIGS. 15 and 16 show a development apparatus in a seventh embodiment of the present invention. The seventh embodiment is different from the first embodiment (FIG. 3) in the points that the backup member 50 in the first embodiment (FIG. 3) is not present, and that a spacer member 70 and a smoky dust prevention sheet 40D are mounted in sequence on the regulation plate 30 fixed onto the casing 13 with the screw 60.

The spacer member 70 is mounted on the downstream face 31 of the regulation plate 30 and extends in a direction orthogonal to the direction that the developer D is transported on the surface 10*a* of the development roller 10 (i.e. in the longitudinal direction of the regulation plate 30).

The spacer member 70 has a thickness larger than a portion of the screw 60 protruding from the downstream face 31 of the regulation plate 30. That is to say, the thickness of the spacer member 70 is larger than the height of the head of the screw 60.

The spacer member 70 is made of, for example, synthetic resin or sheet metal. A plurality of the spacer members 70 are placed along the longitudinal direction of the regulation plate 30. The spacer members 70 are stuck on the regulation plate 30 so that the screw 60 is positioned between the adjacent spacer members 70.

The smoky dust prevention sheet 40D extends in longitudinal direction of the regulation plate 30. A fixed end portion on one end of the smoky dust prevention sheet 40D is glued to a downstream face 71 of the spacer member 70, while a free end portion on the other end of the smoky dust prevention sheet 40D is in contact with the surface 10*a* of the development roller 10.

A confronting face 72 of the spacer member 70 facing the development roller 10 is positioned farther away from the side of the development roller 10 than the confronting face 32 of the regulation plate 30.

In the thus-structured development apparatus, the screw 60 does not protrude from the downstream face 71 of the spacer member 70 because the spacer member 70 mounted on the downstream face 31 of the regulation plate 30 has a thickness larger than a portion of the screw 60 protruding from the downstream face 31 of the regulation plate 30.

Therefore, it is not necessary to provide a hole for the screw 60 in the smoky dust prevention sheet 40D, which makes it possible to glue the smoky dust prevention sheet 40D to the downstream face 71 of the spacer member 70 while keeping uniform rigidity of the smoky dust prevention sheet 40D. Moreover, a glued area of the smoky dust prevention sheet 40D can be increased.

Therefore, it is more reliably prevented to detach the smoky dust prevention sheet 40D from the spacer member 70 when the smoky dust prevention sheet 40D is used in contact with the developer holder 10 in the state that the smoky dust prevention sheet 40D is bended.

Moreover, the downstream face 71 of the spacer member 70 has an almost uniform height over the longitudinal direction. The almost uniform height makes it possible to uniform the pressing force of the smoky dust prevention sheet 40D on the surface 10*a* of the development roller 10 over the longitudinal direction of the sheet 40D. Thereby, irregularity in density of images is reliably prevented.

Further, the confronting face 72 of the spacer member 70 is positioned farther away from the side of the development roller 10 than the confronting face 32 of the regulation plate 30. Therefore, the confronting face 72 of the spacer member 70 does not protrude toward the development roller 10 more than the confronting face 32 of the regulation plate 30. Thus, the confronting face 72 of spacer member 70 does not make any change in the layer thickness of the developer D regulated by the regulation plate 30. This makes it possible to eliminate influence on images.

It is to be noted that the confronting face 72 of the spacer member 70 should preferably be flush with the confronting face 32 of the regulation plate 30, which makes it possible to nearly eliminate a gap (pocket) between the regulation plate 30 and the smoky dust prevention sheet 40D on the side of the development roller 10, thereby reliably preventing the toner from accumulating in the gap.

Eighth Embodiment

Figure 17:
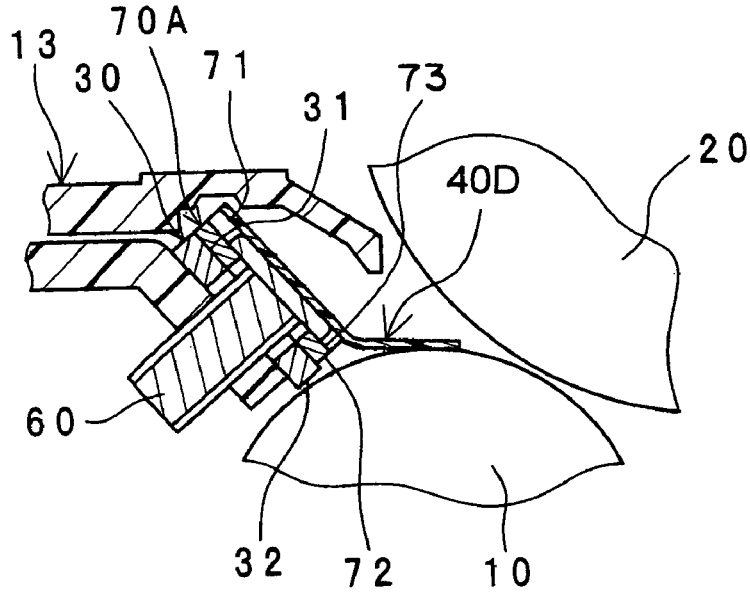
FIG. 17 is a cross-sectional view showing a development apparatus in an eighth embodiment of the present invention in the state that a space member having a vertical groove for housing a screw head is suck to a regulation plate, and that a smoky dust prevention sheet is stuck on the spacer member.
Figure 18:
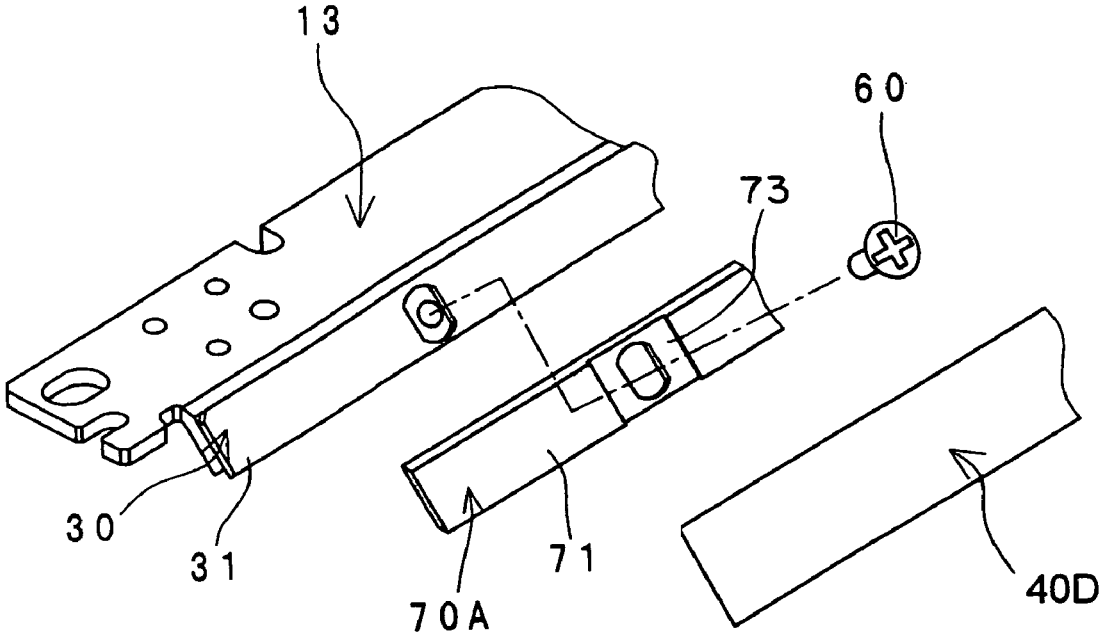
FIG. 18 is a perspective view showing FIG. 17 in an exploded state.

FIG. 17 and FIG. 18 show a development apparatus in an eighth embodiment of the present invention. The eighth embodiment is different from the seventh embodiment (FIG. 15 and FIG. 16) in the points that an integrally formed spacer member 70A is employed instead of a plurality of the spacer members, and that the spacer member 70A is fixed together with the regulation plate 30 onto the casing 13 with the screw 60.

More specifically, the spacer member 70A has a recess groove 73 which extends in the transverse direction of the spacer member 70A and into which the head of the screw 60 is fitted. The depth size of the recess groove 73 is larger than the height size of the head of the screw 60, so that the screw 60 does not protrude from the downstream face 71 of the spacer member 70.

In the thus-structured development apparatus, in addition to the effect of the seventh embodiment, it becomes easy to mount the spacer member 70 on the casing 13 and dismount the spacer member 70 from the casing 13 because the spacer member 70 is integrally formed and fixed onto the casing 13 with the screw 60.

Ninth Embodiment

Figure 19:
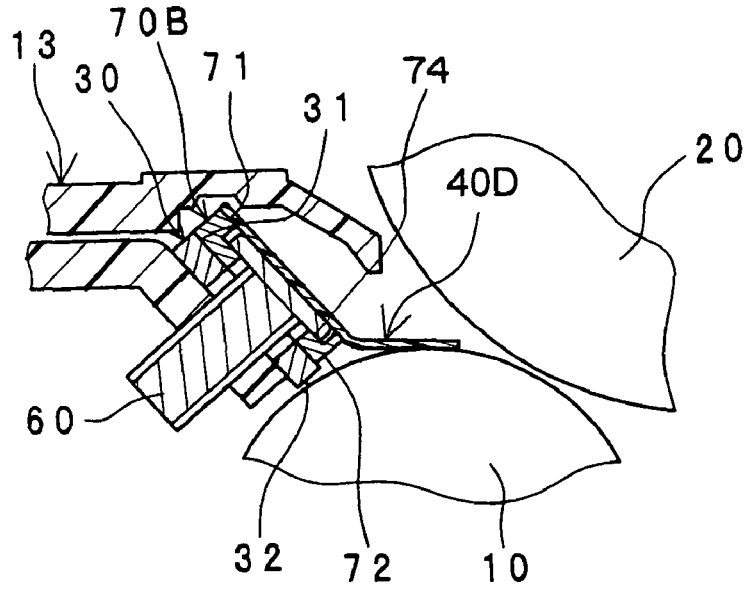
FIG. 19 is a cross-sectional view showing a development apparatus in a ninth embodiment of the present invention in the state that a spacer member having a recess for housing a screw head is stuck on a regulation plate, and that a smoky dust prevention sheet is stuck on the spacer member.
Figure 20:
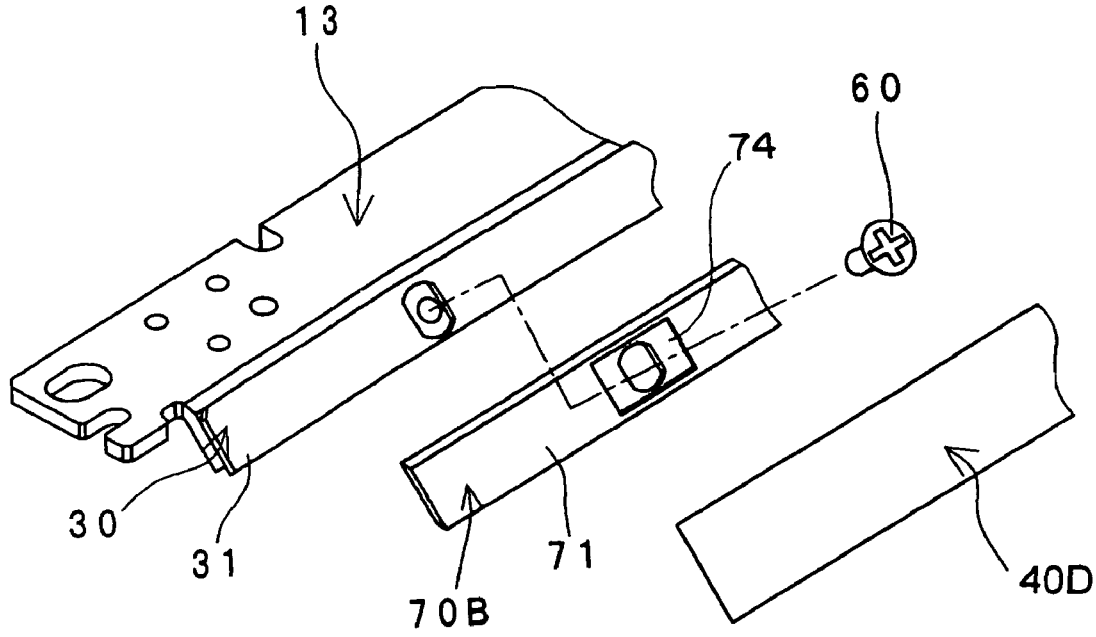
FIG. 20 is a perspective view showing FIG. 19 in an exploded state.

FIGS. 19 and 20 show a development apparatus in a ninth embodiment of the present invention. The ninth embodiment is different from the eighth embodiment (FIG. 17 and FIG. 18) in the points that a spacer member 70*b* has a recess portion 74 instead of the recess groove 73, and that the head of the screw 60 is fitted into the recess portion 74. The depth size of the portion 74 is larger than the height size of the head of the screw 60, so that the screw 60 does not protrude from the downstream face 71 of the spacer member 70. Moreover, there is a glued area to the smoky dust prevention sheet 40D around the recess portion 74.

In the thus-structured development apparatus, in addition to the effect of the eighth embodiment, the smoky dust prevention sheet 40D is glued to the downstream face 71 of the spacer member 70*b* around the recess portion 74, which makes it possible to prevent detachment of the smoky dust prevention sheet 40D with more reliability.

Tenth Embodiment

Figure 21:
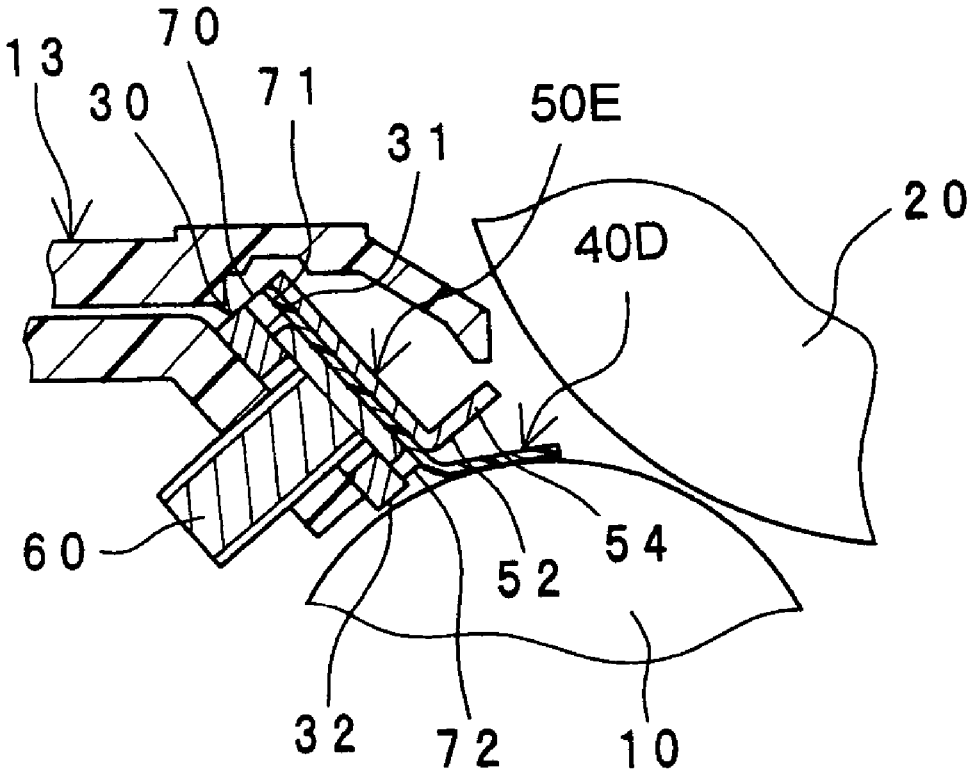
FIG. 21 is a cross-sectional view showing a development apparatus in a tenth embodiment of the present invention in the state that a spacer member identical in thickness to a screw head is stuck on a section of a regulation plate excluding the screw head, that a smoky dust prevention sheet is stuck on the spacer member, and that a backup member is stuck on the smoky dust prevention sheet.

FIG. 21 shows a development apparatus in a tenth embodiment of the present invention. The tenth embodiment is different from the seventh embodiment (FIG. 15 and FIG. 16) in the point that a backup member 50E for sandwiching the fixed end portion of the smoky dust prevention sheet 40D together with the spacer member 70 is provided. The backup member 50E, which is identical in configuration to the backup member 50*b* in the third embodiment (FIG. 6), is glued to the downstream face of the smoky dust prevention sheet 40D.

In the thus-structured development apparatus, in addition to the effect of the seventh embodiment, the backup member 50E more reliably prevents detachment of the smoky dust prevention sheet 40D from the spacer member 70 because the backup member 50E is provided for sandwiching the fixed end portion of the smoky dust prevention sheet 40D together with the spacer member 70.

Moreover, the backup member 50E suppresses lifting of the smoky dust prevention sheet 40D from the spacer member 70 and prevents the smoky dust prevention sheet 40D in the free end portion of the smoky dust prevention sheet 40D from being waved (i.e. having wrinkles). Consequently, it becomes possible to uniform the pressing force of the smoky dust prevention sheet 40D on the surface 10*a* of the development roller 10 over the longitudinal direction of the sheet 40D. This prevents irregularity in density of images.

The confronting face 52 of the folded portion 54 in the backup member 50E has only to be flush with the confronting face 32 of the regulation plate 30 or to be in a position away from the development roller 10 side. Thereby, the confronting face 52 of the folded portion 54 does not make any change in the layer thickness of the developer D regulated by the regulation plate 30.

It should be noted that the present invention is not limited to the above-stated embodiments. Specifically, the developer used for the development apparatus and the image formation apparatus in the embodiments has been a two-component developer containing a toner and a carrier. However, the present invention is also applicable to development apparatuses and image formation apparatuses using a so-called single-component developer containing only toner. Further, the development apparatus of the present invention may be applied to color tandem image formation apparatuses having a plurality of development apparatuses.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

The invention claimed is:

1. A development apparatus, comprising:

a casing having an opening;

a developer holder positioned in the opening of the casing and holding a powder developer in the casing on a surface of the developer holder to transport the powder developer;

a regulation plate mounted on the casing in such a way that an end portion of the regulation plate comes close to the surface of the developer holder so as to regulate a layer thickness of the developer on the surface of the developer holder, the regulation plate extending in a direction orthogonal to a transportation direction of the developer on the surface of the developer holder;

a smoky dust prevention sheet including a fixed end portion extending in the direction orthogonal to the transportation direction of the developer on the surface of the developer holder, wherein the fixed end portion of the smoky dust prevention sheet, is fixed onto a face of the regulation plate corresponding to a downstream side with respect to the transportation direction of the developer, and wherein the other end of the smoky dust prevention sheet, as a feed end portion, extends in the transportation direction of the developer, and is in contact with the surface of the developer holder, a curved inflection portion between the fixed end portion and the feed end portion defining a transition portion;

a backup member having a main body portion for sandwiching the fixed end portion of the smoky dust prevention sheet with the regulation plate and extending in the direction orthogonal to the transportation direction of the developer on the surface of the developer holder and a reinforcement portion connected to the main body portion on a side of the developer holder, the reinforcement portion abutting the transition portion of the smoky dust prevention sheet.

2. The development apparatus as defined in claim 1, wherein the reinforcement portion has a flexural rigidity larger than that of the main body portion.

3. The development apparatus as defined in claim 1, wherein a face of the backup member facing the developer holder is flush with a face of the regulation plate facing the developer holder, or is positioned farther away from the developer holder than the face of the regulation plate.

4. A process cartridge comprising the development apparatus as defined in claim 1.

5. An image formation apparatus comprising the development apparatus as defined in claim 1.

6. The development apparatus as defined in claim 1, further comprising a screw for fixing the regulation plate, the smoky dust prevention sheet, and the backup member together onto the casing, wherein the backup member has an opening portion extending from beyond a screw head to a side of the developer holder.

7. The development apparatus as defined in claim 6, wherein the backup member has a folded portion on the side of the developer holder, the folded portion extending in the direction orthogonal to the transportation direction of the developer on the surface of the developer holder, and the folded portion being folded to an opposite side of the regulation plate, and a transverse cross-sectional outline of a portion of the backup member including the opening portion on a side of the folded portion is identical to a transverse cross-sectional outline of a portion of the backup member excluding the opening portion on the side of the folded portion.

8. The development apparatus as defined in claim 6, wherein the smoky dust prevention sheet has a slit in a position overlapping with the opening portion of the backup member.

9. The development apparatus as defined in claim 6, wherein the smoky dust prevention sheet has a hole portion in a position overlapping with the opening portion of the backup member.

10. The development apparatus as defined in claim 6 wherein the opening portion of the backup member includes at least one slit extending in a direction transverse to the opening portion.

11. The development apparatus as defined in claim 6 wherein a length of the opening portion is almost three times larger than an external diameter of a head of the screw.

12. The development apparatus as defined in claim 1, wherein a confronting face of the backup member is flush with a confronting face of the regulation plate.

13. A development apparatus, comprising:

a casing having an opening;

a developer holder positioned in the opening of the casing and holding a powder developer in the casing on a surface of the developer holder to transport the powder developer;

a regulation plate mounted on the casing in such a way that an end portion of the regulation plate comes close to the surface of the developer holder so as to regulate a layer thickness of the developer on the surface of the developer holder, the regulation plate extending in a direction orthogonal to a transportation direction of the developer on the surface of the developer holder;

a smoky dust prevention sheet including a fixed end portion extending in the direction orthogonal to the transportation direction of the developer on the surface of the developer holder, wherein the fixed end portion of the smoky dust prevention sheet, is fixed to the face of the regulation plate corresponding to the downstream side with respect to the transportation direction of the developer, and wherein the other end of the smoky dust prevention sheet, as a feed end portion extends in the transportation direction of the developer, and is in contact with the surface of the developer holder, a curved inflection portion between the fixed end portion and the feed end portion defining a transition portion;

a backup member for sandwiching the fixed end portion of the smoky dust prevention sheet with the regulation plate and extending in the direction orthogonal to the transportation direction of the developer on the surface of the developer holder, the backup member having a folded portion on the side of the developer holder, the folded portion extending in the direction orthogonal to the transportation direction of the developer on the surface of the developer holder, and the folded portion being folded to an opposite side of the regulation plate, wherein the folded portion abuts the transition portion of the smoky dust prevention sheet.

14. A process cartridge comprising the development apparatus as defined in claim 8.

15. An image formation apparatus comprising the development apparatus as defined in claim 13.

16. The development apparatus as in claim 13, further comprising:

a screw for fixing the regulation plate onto the casing;

a rigid spacer member mounted on a face of the regulation plate corresponding to a downstream side with respect to the transportation direction of the developer, the spacer member having a thickness larger than a portion of the screw protruding from the face of the regulation plate corresponding to the downstream side with respect to the transportation direction of the developer, and the spacer member extending in the direction orthogonal to the transportation direction of the developer on the surface of the developer holder.

17. The development apparatus as defined in claim 16, wherein a face of the spacer member facing the developer holder is flush with a face of the regulation plate facing the developer holder, or is positioned farther away from the developer holder than the face of the regulation plate.

18. The development apparatus as defined in claim 16, wherein the rigid spacer member is formed of metal.

19. A development apparatus, comprising:

a casing having an opening;

a developer holder positioned in the opening of the casing and holding a powder developer in the casing on a surface of the developer holder to transport the powder developer;

a regulation plate mounted on the casing in such a way that an end portion of the regulation plate comes close to the surface of the developer holder so as to regulate a layer thickness of the developer on the surface of the developer holder, the regulation plate extending in a direction orthogonal to a transportation direction of the developer on the surface of the developer holder;

a screw for fixing the regulation plate onto the casing;

a smoky dust prevention sheet extending in the direction orthogonal to the transportation direction of the developer on the surface of the developer holder, wherein one end of the smoky dust prevention sheet, as a fixed end portion, is fixed onto a face of the regulation plate corresponding to a downstream side with respect to the transportation direction of the developer, and wherein the other end of the smoky dust prevention sheet, as a feed end portion, is in contact with the surface of the developer holder;

a backup member for sandwiching the fixed end portion of the smoky dust prevention sheet with the regulation plate and extending in the direction orthogonal to the transportation direction of the developer on the surface of the developer holder; and wherein at least one of the smoky dust prevention sheet and the backup member include a leak-off hole, said leak-off hole having a diameter larger than an external diameter of a head of the screw.

* * * * *

UNITED STATES PATENT AND TRADEMARK OFFICE

CERTIFICATE OF CORRECTION

PATENT NO. : 7,751,744 B2
APPLICATION NO. : 11/480374
DATED : July 6, 2010
INVENTOR(S) : Yoshiki Ohmichi et al.

It is certified that error appears in the above-identified patent and that said Letters Patent is hereby corrected as shown below:

Claim 14 - Column 16, Line 65: Change "... as defined in claim 8." to -- ... as defined in claim 13. --

Signed and Sealed this

Thirtieth Day of November, 2010

David J. Kappos

David J. Kappos
*Director of the United States Patent and Trademark Office*